US008429884B2

(12) United States Patent
Roberts

(10) Patent No.: US 8,429,884 B2
(45) Date of Patent: Apr. 30, 2013

(54) EQUINE TRAINING DEVICE

(76) Inventor: David Roberts, Lowell, FL (US)

( * ) Notice: Subject to any disclaimer, the term of this patent is extended or adjusted under 35 U.S.C. 154(b) by 735 days.

(21) Appl. No.: 12/592,589

(22) Filed: Nov. 30, 2009

(65) Prior Publication Data

US 2010/0146913 A1 Jun. 17, 2010

Related U.S. Application Data

(60) Provisional application No. 61/200,454, filed on Nov. 28, 2008.

(51) Int. Cl.
*B68B 1/00* (2006.01)
*B68B 1/02* (2006.01)

(52) U.S. Cl.
USPC ..... 54/71; 54/6.2; 54/24

(58) Field of Classification Search ..... 54/6.1, 54/6.2, 24, 85, 36, 71
See application file for complete search history.

(56) References Cited

U.S. PATENT DOCUMENTS

| | | | | |
|---|---|---|---|---|
| 429,496 | A * | 6/1890 | Bigelow et al. | 54/36 |
| 4,453,371 | A * | 6/1984 | Abbott-Davies | 54/35 |
| 7,992,368 | B2 * | 8/2011 | Bentley | 54/71 |
| 2005/0044823 | A1 * | 3/2005 | Collins | 54/6.1 |

FOREIGN PATENT DOCUMENTS

| | | | |
|---|---|---|---|
| DE | 3941835 | A1 * | 7/1990 |
| DE | 102008022203 | A1 * | 6/2010 |
| FR | 2596744 | A1 * | 10/1987 |
| FR | 2778906 | A1 * | 11/1999 |
| GB | 2110515 | A * | 6/1983 |

* cited by examiner

*Primary Examiner* — Son T Nguyen
(74) *Attorney, Agent, or Firm* — Massinger Law Offices

(57) ABSTRACT

An equine training apparatus used in conjunction with: 1) a bridle supporting a bit, 2) a noseband, 3) riding reins connected to the bit, and 4) a breastplate, the apparatus comprising a head communication assembly comprising a cord member having a first end attached to a first O-ring, a second end attached to a second O-ring and noseband connection means between said first end and said second end and dividing said cord member into a first fork and a second fork; a sliding member in slidable engagement with said first fork and said second fork; and fork-body connection means for anchoring said sliding member to any of a breast plate, neckstrap, girth, cinch or the like. The sliding member acts as a pulley about which at least one fork is disposed and, when anchored to body tack via fork-body connection means provides a pivot point about which each fork may act; the sliding member effectively divides force applied through the reins into a mouth force component and a nose force component.

20 Claims, 4 Drawing Sheets

EQUINE TRAINING DEVICE

RELATED APPLICATION

This application claims the benefit of U.S. Provisional Application No. 61/200,454, filed Nov. 28, 2008 and entitled, Equine Training Apparatus.

FIELD OF THE INVENTION

The present invention relates generally to horse tack and more specifically to that variety of tack used to impart control over, and improve communication with, a horse's head. The subject apparatus therefore serves as a training aid to, inter alia, discourage head positions which throw the horse out of balance, particularly during abrupt stops and turns encountered in various speed and agility events, and as a rider safety aid that prevents the horse from raising its head above a desired height.

BACKGROUND

The subject equine training apparatus falls loosely into the category of tack known as martingales. A martingale is a piece of equipment that keeps a horse from raising its head too high. Various styles can be used as a control measure, to prevent the horse from avoiding rider commands by raising its head out of position; or as a safety measure to keep the horse from tossing its head high or hard enough to strike its rider in the face. They are permitted in many types of competition, especially those where speed or jumping may be required.

Martingales are attached to the horse's body in one of two ways. They are either attached to the center chest ring of a breastplate (also known as a breastcollar, breaststrap and breastgirth) or, if no breastplate is worn, they are attached by two straps, one that goes around the horse's neck, and the other that attaches to the girth, with the martingale itself beginning at the point in the center of the chest where the neck and girth straps intersect.

The other end of a martingale is attached to the horse's head in two ways, depending upon whether the martingale is a "running martingale" or a "standing martingale".

A running martingale or "training fork" (Western) has two strips of leather with O-rings at the ends through which the reins are threaded. When the head is in a normal position, the reins form a straight line from the bit, through the rings to the rider's hands. A running martingale discourages a horse from raising his head too high and jutting his nose out to evade the bit's action, but also allows the horse freedom of movement when needed. Each rein runs through a ring, thus providing a point of leverage to aid in teaching the horse to yield to pressure from the rider's hands. If the horse raises his head above a certain point, the martingale restricts the movement of the reins, which in turn causes the bit to bear down on the bars of the horse's mouth. Rubber "stops" on the reins prevent the rings from sliding too far toward the bit, where they might get caught on fastenings. Another stop is placed where the martingale strap runs from the girth through the neck strap so that the martingale doesn't form a dangerous loop that the horse might put a foot through. A variation of the running martingale is illustrated and described in U.S. Pat. No. 773,015 issued to Kenny in 1904. Note that the reins are attached to a halter rather than the bit rings, however.

A standing martingale (or "tie down" in western riding) is intended primarily to prevent the horse from flipping its head up when asked to abruptly stop or turn in speed events and is comprised of a single strap that attaches to the girth, passes between the horse's front legs and is fixed to the back of a noseband or cavesson of a bridle under the horse's jaw. To prevent it from catching on other objects, it is also used in conjunction with a neck strap or breast plate. The standing martingale acts on the horse's nose (rather than its mouth through the bit) and creates an absolute limit to how high a horse can raise its head. Being a set length, it doesn't have any "give." Standard adjustment of a standing martingale allows enough slack to bring the strap to the horse's throatlatch when the animal has its head in a relaxed, natural position, although its western counterpart, the tiedown, is adjusted much shorter. If the horse attempts to throw his head up in the air, he reaches the end of the slack in the martingale which prevents further lifting movement. Unlike the running martingale, it limits the freedom of the horse's head, no matter how long or short the reins may be. The harness of Baikie described in U.S. Pat. No. 434,421 which was issued in 1890 resembles a conventional tie down.

There exist several other variations of martingales in the prior art. The German Martingale, for instance, and also called a Market Harborough, consists of a split fork that comes up from the chest, runs through the rings of the bit and attaches to rings on the reins of the bridle between the bit and the rider's hand. It acts in a manner similar to a running martingale, but with greater leverage. It is not show legal and is used primarily as a training aid.

The Chambon runs from the girth, forks about half way, continues through rings on either side of the horse's head at the base of the ears and then follows the direction of the cheek pieces and is attached to the bit ring. The Chambon is said to achieve great vertical flexion with little pressure on the reins. U.S. Pat. No. 4,214,420 issued to Ferree in 1980 teaches a harness device substantially similar to the Chambon.

The de Gogue is a training device based on the theory that unschooled horses have three points of resistance: the poll, the mouth, and the base of the neck. The de Gogue is a triangular system to release that tension and is made of a leather or nylon strap with cords attached. These cords fork at the horse's chest and each run through one of the bit rings. The cord then follows the cheekpiece of the bridle up to a ring or pulley at the side of the browband, before going back down to snap to the leather piece near the chest. The Gogue is essentially an adaptation of the Chambon.

The following additional U.S. patents and applications relating to equine training aids and the like are incorporated herein by reference: U.S. Pat. No. 69,106 entitled Safety Bridle; U.S. Pat. No. 369,294 entitled Device for Preventing Horses from Kicking; U.S. Pat. No. 434,421 entitled Harness; U.S. Pat. No. 647,102 entitled Anti-Jumping Strap; U.S. Pat. No. 773,015 entitled Martingale; U.S. Pat. No. 1,572,506 entitled Controlling Rein; U.S. Pat. No. 1,582,635 entitled Polo Bridle; U.S. Pat. No. 3,657,863 entitled Bosal Device; U.S. Pat. No. 3,906,707 entitled Horse Tie Down; U.S. Pat. No. 4,214,420 entitled Harness Device; U.S. Pat. No. 4,453,371 entitled Harness for a Horse; U.S. Pat. No. 4,495,753 entitled Control Halter; and U.S. Pat. No. 6,349,527 entitled Equestrian Training Device. While many devices of the prior art are intended to control a horse's head movement using force delivered to the mouth (in either direct or leveraged fashion), and other devices of the prior art are intended to control a horse's head movement using force to the nose, none of the above references teach or suggest an equine training apparatus designed to divide a pulling force delivered through the reins into two cooperating sub-forces, namely a first sub-force delivered to the horse's mouth (in either direct or leveraged fashion depending on the height of the horse's head), and a second sub-force delivered to the horse's nose (which is always delivered indirectly through a floating pivot system.

All patents, patent applications, provisional applications, and publications referred to or cited herein, or from which a claim for benefit of priority has been made, are incorporated herein by reference in their entirety to the extent they are not inconsistent with the explicit teachings of this specification.

SUMMARY OF THE INVENTION

In order to meet the need in the art, the subject equine training apparatus has been created. At least one preferred embodiment of the invention is discussed below.

According to the present invention there is provided a training apparatus for a horse, comprising two primary components, namely 1) a pivot assembly comprised of a length adjustable strap having breastplate and girth connection means and terminating at one end in a pivot ring, and 2) a head communication assembly comprised of a flexible cord member in slidable engagement with intermediate noseband connection means, said noseband connection means being slidably disposed through said pivot ring to form first and second fork members having terminal first and second O-rings, respectively, said O-rings being intended for slidable engagement with conventional riding reins as herein described.

By means of this construction is provided a martingale-like apparatus which may be used in conjunction with an ordinary: 1) bridle supporting a bit and having either a noseband or cavesson, 2) riding reins, 3) girth, and/or 4) breastplate or neckstrap, and by means of which the horse's head may be drawn down and back into a desired position for balance and collection of the horse while still permitting freedom of head movement when needed such as during a full gallop. More specifically, an end of the adjustable strap is connected to the girth, passed between the forelegs of the horse and then supported by connection to a breastplate or neckstrap. In another embodiment, the end of the strap may be attached to the breastplate or neckstrap only although the former embodiment is preferred. In both embodiments, the opposite end of the strap terminates in what may now be characterized as a "floating" pivot ring. Left and right riding reins are threaded through first and second O-ring and then connected to a bit in the usual fashion. The noseband connection means, preferably but not essentially in the form of a swivel snap or swivel mounted scissor snap, is passed through the pivot ring and then connected to the back of a noseband or cavesson underneath the horse's jaw. The standard adjustment of the subject equine training apparatus is to set the pivot ring and depending O-rings at a height where the latter do not engage and add leverage to the reins when the horse carries its head at the desired height. In this condition of the system, the rider has direct contact with the bit, and the cord member is slacked.

In operation, when either the rider raises the reins or the horse raises its head, or both, the O-rings are caused to engage the reins creating leveraged, rather than direct, contact with the bit. Because of the lever action, it is believed that less force need be applied to the mouth to achieve the desired correction. This facilitates the rider having "soft hands". Perhaps of greater importance though is the fact that when the slack in the cord member is taken up, part of the pulling force being transmitted through the reins is transferred through the cord member to the noseband or cavesson. Applicant has observed that the division of rein force ($F_r$) into a mouth force component ($F_m$) and a nose force component ($F_n$) encourages the horse to make the desired correction in head position with greater speed and ease than heretofore experienced with training aids of the prior art resulting in accelerated training.

It is believed that the sum of the mouth force and nose force vector quantities remain equal to the rein force vector quantity regardless of the orientation of the components of the subject apparatus during use as governed by rider hand position and horse head position. Accordingly, it is believed that $F_r=F_m+F_n$ at all times, even when $F_n=0$ which is the case when the horse's head is not raised above the desired height. Because the orientation of components relative to one another as well as to the associated tack changes on both vertical and horizontal planes as horse and rider move, an infinite number of component geometries and corresponding vector quantities are encountered.

There has thus been outlined, rather broadly, the more important components and features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its advantages and the specific objects attained by its uses, reference should be had to the accompanying drawings and descriptive matter in which there is illustrated a preferred embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENT

Figure 1:
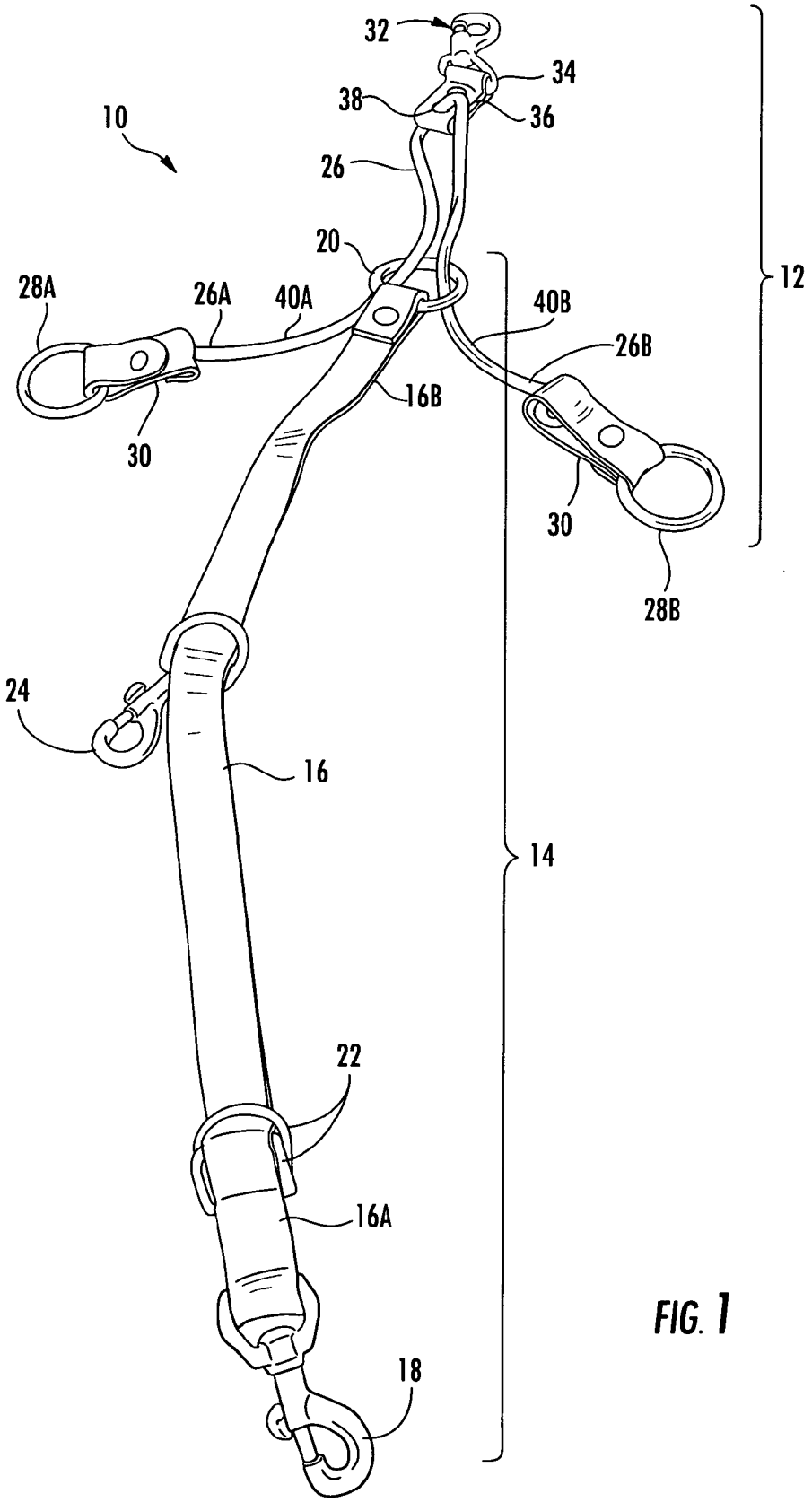
FIG. 1 is a perspective plan view of the subject equine training apparatus.

Reference is first made to FIG. 1 in which there is illustrated a plan view of the equine training apparatus of the present invention designated generally by reference numeral 10. The apparatus is comprised of two primary components, namely 1) a head communication assembly 12 and fork-body assembly 14.

Head communication assembly 12 is comprised of a length of flexible cord-like member 26, preferably but not essentially constructed of braided rope or other suitable material, having a first end 26A and a second end 26B terminating in first O-ring 28A and second O-ring 28B, respectively. First and second O-rings 28A,28B may be attached to corresponding cord member ends 26A,26B using various well known means including conventional knots, or as in the embodiment illustrated, by looping a length of strapping material 30 around each O-ring, permanently closing the loop via stitching and/or riveting, inserting the cord end through an aperture in the loop and then tying knot in the end of the cord to prevent it from retreating from the aperture. O-rings 28A,28B are intended for slidable engagement around conventional riding reins as described in greater detail below. Head communication assembly 12 further includes noseband connection means preferably in the form of third swivel snap 32 (shown) or a swivel mounted scissor snap (not shown) connected to cord member 26 between ends 26A,26B, preferably at the midpoint of cord member 26. The term "noseband" as used herein refers to any tack encircling a horse's muzzle, typically just below the cheekbones, including conventional nosebands, a cavesson, etc. Those skilled in the art should readily appreciate that, as an alternative, noseband connection means may be connected to one end of two separate cord members of equal length to accomplish the same cord-connector-cord configuration.

Cord member 26 may be threaded directly through snap ring 34 of swivel snap 32 and fixed in the desired location along its length (midpoint) in a variety of ways. In another embodiment, however, a short length of strapping 36 is looped through snap ring 34 and closed via stitching and/or riveting and an aperture 38 disposed through the loop of strapping through which cord member 26 is disposed. The diameter of aperture 38 is sized to provide a snug fit with cord member 26 so that slidable engagement is permitted, but requiring a quantum of force to overcome the inherent frictional force. This method of construction makes the head communication assembly 12 easier to manage.

Noseband connection means effectively divides cord member 26 into first and second fork members 40A and 40B, respectively. Accordingly, one end of each fork terminates in noseband connection means while the other end terminates in an O-ring for the receipt of a riding rein therethrough as described below.

Fork-body assembly 14 is comprised of at least one sliding member 20 sized to receive at least one fork 40A,B therein in sliding engagement, and is further comprised of fork-body connection means for anchoring sliding member 20, directly or indirectly, to any of a breast plate, neck strap, girth or other riding tack ("body tack") serving as a point of attachment in close proximity to the horse's chest.

Each sliding member 20 acts as a pulley of sorts about which at least one fork 40A,B is disposed and, when anchored to body tack via fork-body connection means provides a pivot point about which cord member 26 may act; the sliding member 20 effectively divides force applied through the reins into a mouth force component and a nose force component. In one embodiment, sliding member 20 is comprised of a simple O-ring (shown) in slidable engagement with both forks 40A, B. Sliding member 20 is attached to fork-body connection means which in the embodiment illustrated is comprised of a length adjustable strap 16 constructed of leather, nylon or other suitable material and having a first end 16A and second end 16B. First end 16A terminates in first swivel snap 18 for attachment to body tack. When anchoring sliding member 20 to a girth (or cinch), other suitable connection means well known in the art may be employed such as a leather loop through which the girth/cinch is inserted. Second end 16B terminates in sliding member 20. Swivel snap 18 and sliding member 20 may be secured to strap 16 by conventional methods such as looping the ends 16A and 16B through these components and then permanently closing the loop by stitching or rivets. The length of strap 16 may be adjusted using well known length adjustment means such as the pair of D-rings 22 shown or buckles. When anchoring sliding member 20 to a girth/cinch it is essential for safety reasons that strap 16 be attached to a breastplate or neckstrap to keep strap 16 close to the horse's body rather than hanging freely. A second swivel snap 24 may be mounted to strap 16 along its length for this purpose. Those skilled in the art should readily appreciate that sliding member 20 could be anchored directly to the breastplate or neckstrap in proximity to the horse's chest although mounting to the girth is preferred because it is more restricted in movement.

It should be further appreciated that alternative constructions of both sliding member 20 and fork-body connection means may be employed. For instance, sliding member 20 may be comprised of the closed loop portion of a snap-ring (normally used for mounting to a strap or other substrate) with the spring-biased snap portion serving as the fork-body connection means used to anchor the sliding member to the body tack. One snap-ring may be slidably mounted to first fork 40A and a second snap-ring may be mounted to second fork 40B. Each snap-ring may then be removably mounted to a breastplate or neckstrap.

Figure 2:
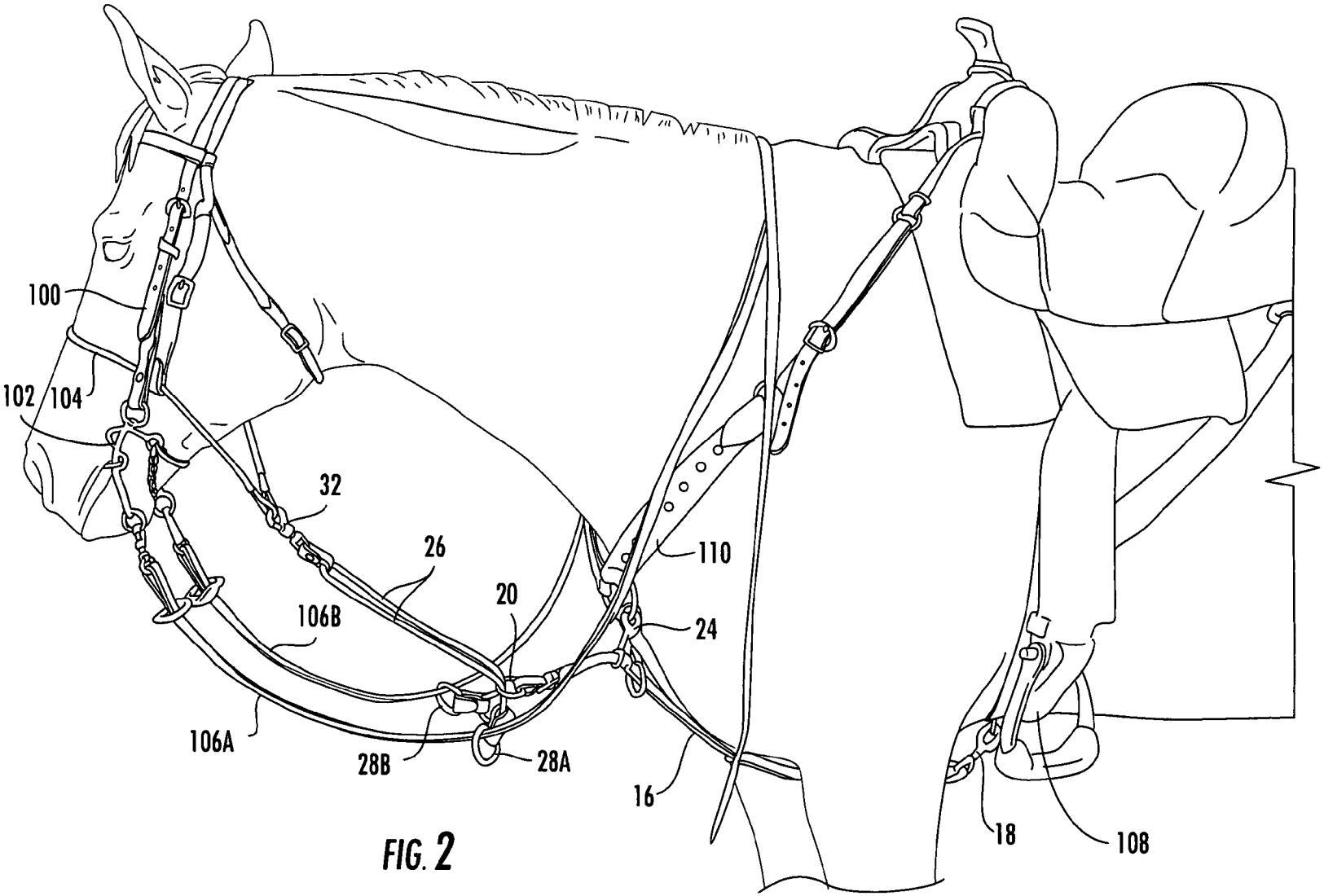
FIG. 2 is a perspective side view of the invention of FIG. 1 attached to a tacked up horse with head in a relaxed position.

By means of the above described construction is provided a martingale-like apparatus which may be used in conjunction with ordinary riding tack as illustrated in FIG. 2, including the following: 1) a bridle 100 supporting a bit 102, 2) a noseband 104 (or cavesson not shown) which may be integrated with bridle 100 or a separate piece of tack as illustrated, 3) left and right riding reins 106A,106B in communication with bit 102, 4) a girth 108, and 5) either a breastplate 110 or neckstrap (not shown). When the subject apparatus is properly installed with the above riding tack there is created a means by which the horse's head may be drawn down and back into a desired position for balance and collection of the horse while still permitting freedom of head movement when needed such as during turns and some forward movement such as during a gallop, for instance.

More specifically, first swivel snap 18 of adjustable strap 16 is connected to girth 108. Strap 16 is then passed between the forelegs of the horse and then supported by removable connection to breastplate 110 using second swivel snap 24. Note that some breastplates are equipped with a ring through which strap 16 may be inserted as shown for additional security it being the goal to prevent strap 16 from sagging to create a dangerous loop in which the horse's foot could be trapped. In another embodiment, a shorter version of strap 16 may be employed the end of which is attached directly to the breastplate rather than passing down between the horses forelegs to the girth although the illustrated embodiment is preferred. Left and right riding reins 106A,106B are threaded through first and second O-rings 28A,28B, respectively, and then connected to bit 102 in the usual fashion. Third swivel snap 32 of the noseband connection means is passed through sliding member 20 as previously described and then connected to the back of noseband 104 underneath the horse's jaw.

Figure 3:
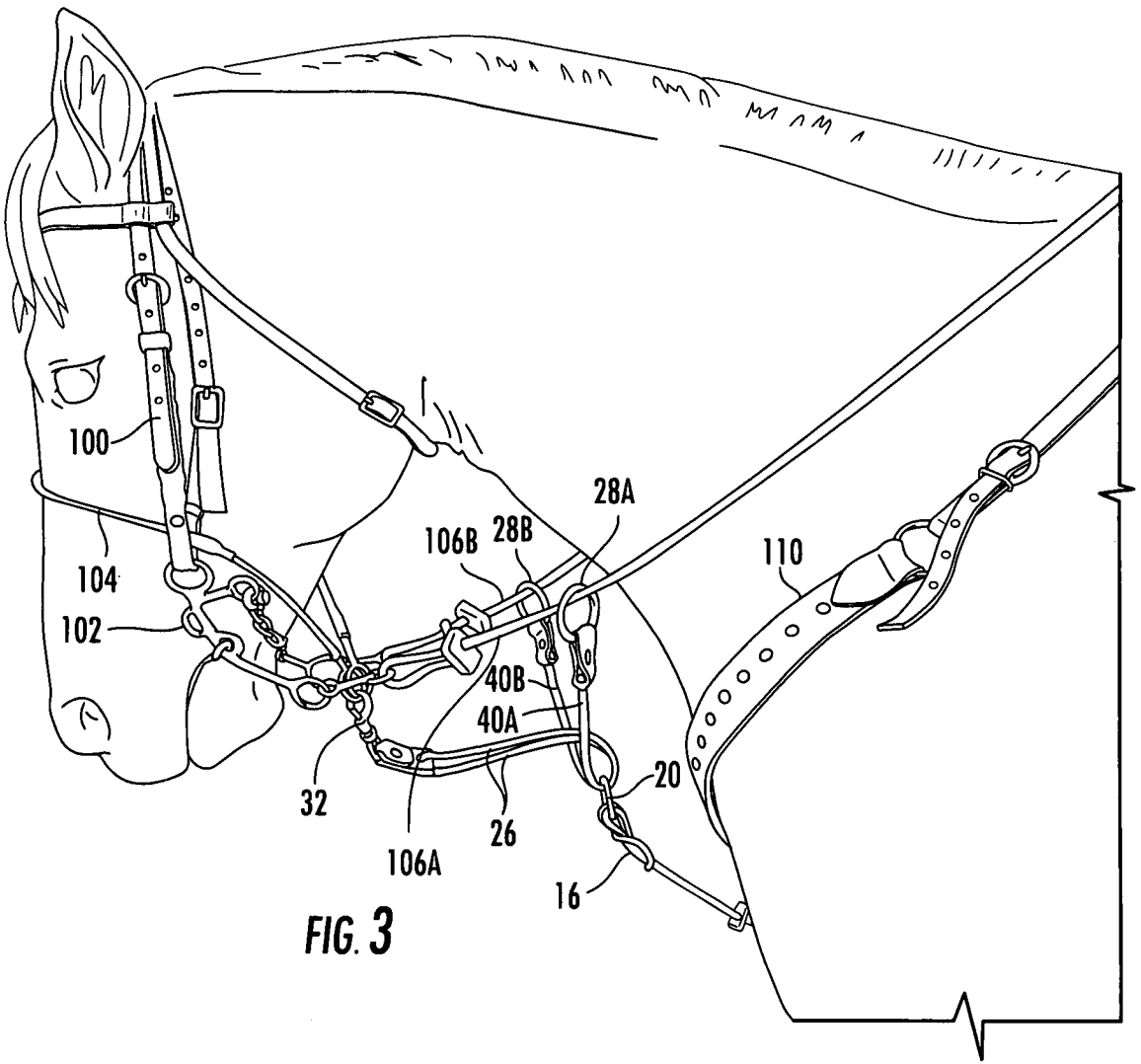
FIG. 3 is a perspective side view of the invention of FIG. 1 attached to a tacked up horse with head in a tucked position.

Reference now being made to FIG. 3, the standard adjustment of the subject equine training apparatus is to set sliding member 20 and depending O-rings 28A,28B at a height where the latter do not engage and add leverage to reins 106A,106B when the horse carries its head at the desired height. In this condition of the system, the rider has direct contact with the bit 102, and cord member 26 is slacked.

Figure 4:
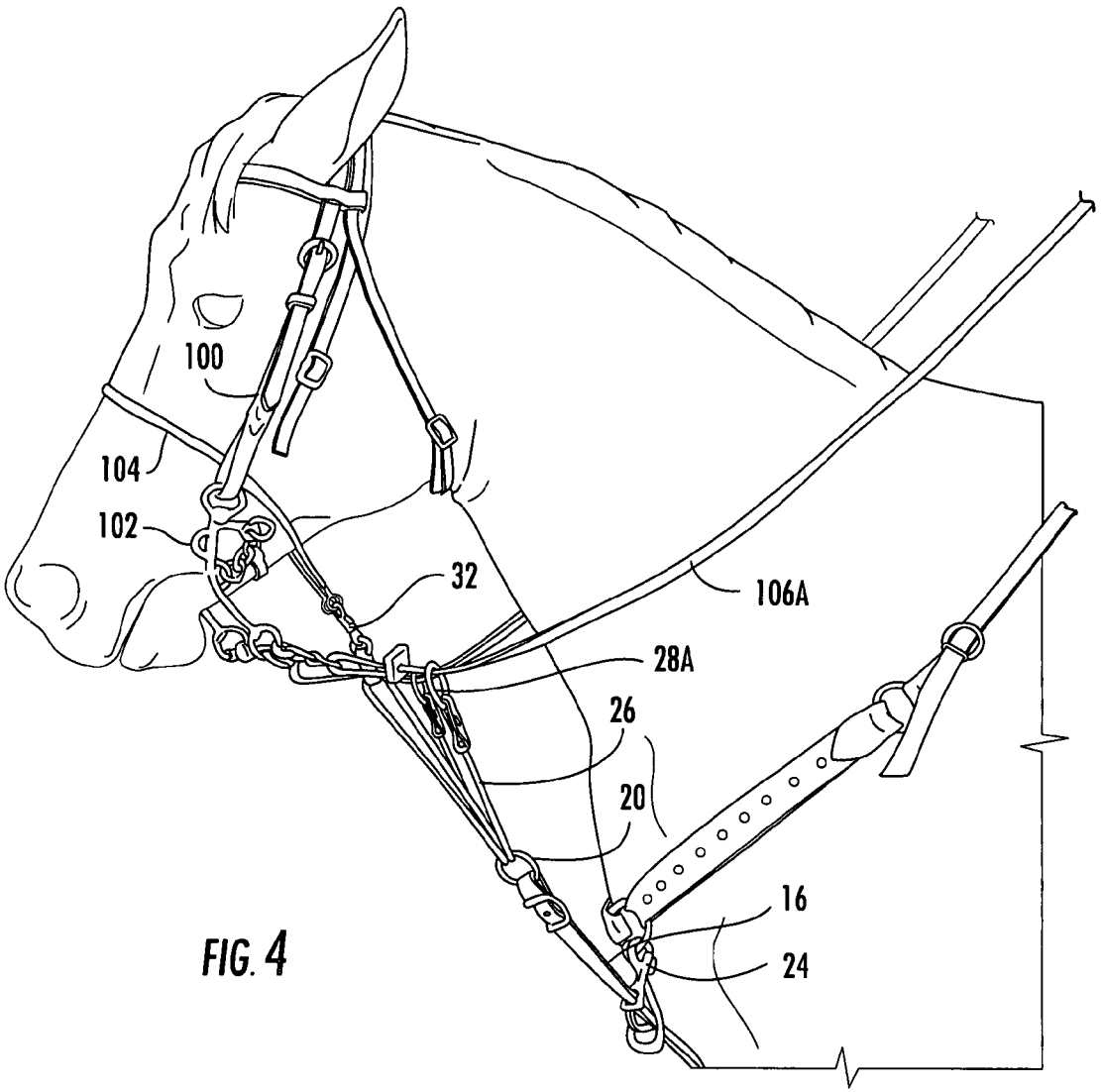
FIG. 4 is a perspective side view of the invention of FIG. 1 attached to a tacked up horse with head in a raised position.

Reference now being made to FIG. 4, note that when either the rider raises at least one riding rein 106A,106B or the horse raises its head, or both, O-rings 28A,28B are caused to engage the reins creating leveraged, rather than direct, contact with bit 102. Sliding member 20 in this sense may be considered a pulley to reduce the amount of force the rider must exert on the reins to correct the movement thus promoting the always desired and strived for "soft hands".

Perhaps of greater importance though is the fact that when the slack in cord member 26 is taken up, part of the pulling force being transmitted through reins 106A,1066 is transferred through cord member 26 to noseband 104. In other words, instead of correctional force being applied solely to the horse's mouth, the correctional force is divided into a mouth force component and a nose force component the combination of which has been demonstrated to encourage the horse to make the desired correction in head position with greater speed and ease than heretofore experienced with training aids of the prior art resulting in accelerated training.

The subject equine training apparatus 10 is meant to help rebalance a horse by coming into play only when the horse's head gets out of position. It is not meant to force the horse into a restrictive head carriage and is not intended to be a substitute for gentle hands or effective leg and seat cues.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specifications, but rather only by the scope of the claims appended hereto.

What is claimed as being new, useful and desired to be protected by Letters Patent of the United States is as follows:

1. An equine training apparatus used in conjunction with: 1) a bridle supporting a bit, 2) a noseband, 3) riding reins connected to the bit, and 4) a breastplate, the apparatus comprising:

a) a head communication assembly comprising a cord member having a first end attached to a first O-ring, a second end attached to a second O-ring, and noseband connection means between said first end and said second end and dividing said cord member into a first fork and a second fork;

b) a sliding member in slidable engagement with said first fork and said second fork; and c) fork-body connection means for anchoring said sliding member to the breastplate.

2. The equine training apparatus of claim 1 wherein said sliding member is alternatively mounted to a neckstrap, girth, cinch or other body tack serving as a point of attachment in close proximity to an equine's chest, rather than to a breastplate.

3. The equine training apparatus of claim 2 wherein said sliding member is mounted indirectly to the neckstrap, girth, cinch or other body tack serving as a point of attachment in close proximity to an equine's chest.

4. The equine training apparatus of claim 3 wherein the riding reins comprise a left rein and a right rein which pass through said first O-ring and said second O-ring, respectively.

5. The equine training apparatus of claim 2 wherein the riding reins comprise a left rein and a right rein which pass through said first O-ring and said second O-ring, respectively.

6. The equine training apparatus of claim 2 wherein said fork-body connection means length adjustable.

7. The equine training apparatus of claim 1 wherein said sliding member is mounted indirectly to the breastplate.

8. The equine training apparatus of claim 7 wherein the riding reins comprise a left rein and a right rein which pass through said first O-ring and said second O-ring, respectively.

9. The equine training apparatus of claim 1 wherein the riding reins comprise a left rein and a right rein which pass through said first O-ring and said second O-ring, respectively.

10. The equine training apparatus of claim 1 wherein said fork-body connection means is length adjustable.

11. An equine training apparatus used in conjunction with: 1) a bridle supporting a bit, 2) a noseband, 3) riding reins connected to the bit, and 4) a breastplate, the apparatus comprising:

a) a head communication assembly comprising a cord member having a first end attached to a first O-ring, a second end attached to a second O-ring, and noseband connection means between said first end and said second end and dividing said cord member into a first fork and a second fork;

b) at least one sliding member in slidable engagement with at least one of said first fork and said second fork; and c) fork-body connection means for anchoring said first sliding member and said second sliding member to the breastplate.

12. The equine training apparatus of claim 11 wherein said at least one sliding member is alternatively mounted to a neckstrap, girth, cinch or other body tack serving as a point of attachment in close proximity to an equine's chest, rather than to a breastplate.

13. The equine training apparatus of claim 12 wherein said at least one sliding member is mounted indirectly to the neckstrap, girth, cinch or other body tack serving as a point of attachment in close proximity to an equine's chest.

14. The equine training apparatus of claim 13 wherein the riding reins comprise a left rein and a right rein which pass through said first O-ring and said second O-ring, respectively.

15. The equine training apparatus of claim 12 wherein the riding reins comprise a left rein and a right rein which pass through said first O-ring and said second O-ring, respectively.

16. The equine training apparatus of claim 12 wherein said fork-body connection means is length adjustable.

17. The equine training apparatus of claim 11 wherein said at least one sliding member is mounted indirectly to the breastplate.

18. The equine training apparatus of claim 17 wherein the riding reins comprise a left rein and a right rein which pass through said first O-ring and said second O-ring, respectively.

19. The equine training apparatus of claim 11 wherein the riding reins comprise a left rein and a right rein which pass through said first O-ring and said second O-ring, respectively.

20. The equine training apparatus of claim 11 wherein said fork-body connection means is length adjustable.

* * * * *